US011164524B2

(12) United States Patent
Li et al.

(10) Patent No.: US 11,164,524 B2
(45) Date of Patent: Nov. 2, 2021

(54) PIXEL DRIVING CIRCUIT, PIXEL DRIVING METHOD AND DISPLAY DEVICE

(71) Applicant: BOE TECHNOLOGY GROUP CO., LTD., Beijing (CN)

(72) Inventors: Shengnan Li, Beijing (CN); Xueling Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/767,053

(22) PCT Filed: Dec. 18, 2019

(86) PCT No.: PCT/CN2019/126182
§ 371 (c)(1),
(2) Date: May 26, 2020

(87) PCT Pub. No.: WO2020/155902
PCT Pub. Date: Aug. 6, 2020

(65) Prior Publication Data

US 2021/0074214 A1 Mar. 11, 2021

(30) Foreign Application Priority Data

Jan. 29, 2019 (CN) ..... 201910085298.3

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0819* (2013.01);
(Continued)

(58) Field of Classification Search
None
See application file for complete search history.

(56) References Cited

U.S. PATENT DOCUMENTS

2003/0156084 A1 8/2003 Tsuchiya et al.
2008/0169754 A1* 7/2008 Yang ..... G09G 3/3233 313/504

(Continued)

FOREIGN PATENT DOCUMENTS

CN 1440010 A 9/2003
CN 103839513 A 6/2014

(Continued)

OTHER PUBLICATIONS

International Search Report of PCT/CN2019/126182 and English translation, dated Mar. 18, 2020, 19 pages.

(Continued)

*Primary Examiner* — Dorothy Harris
(74) *Attorney, Agent, or Firm* — Muncy, Geissler, Olds & Lowe, P.C.

(57) ABSTRACT

A pixel driving circuit, a pixel driving method and a display device are provided. The pixel driving circuit includes a driving circuit, an initialization circuit and a compensation control circuit. The compensation control circuit is configured to control a control end of the driving circuit to be electrically connected to a second end of the driving circuit under the control of a compensation control line. The initialization circuit is configured to write an initial voltage into the second end of the driving circuit under the control of an initialization control line.

13 Claims, 4 Drawing Sheets

(52) U.S. Cl.
CPC ..... *G09G 2310/0272* (2013.01); *G09G 2310/061* (2013.01)

(56) References Cited

U.S. PATENT DOCUMENTS

| | | | | |
|---|---|---|---|---|
| 2012/0235972 | A1 | 9/2012 | Liu Wang et al. | |
| 2014/0145917 | A1* | 5/2014 | Kwak | G09G 3/3233 345/82 |
| 2016/0133191 | A1 | 5/2016 | Kang et al. | |
| 2016/0267843 | A1 | 9/2016 | Wang et al. | |
| 2017/0061880 | A1 | 3/2017 | Choi et al. | |
| 2017/0249898 | A1* | 8/2017 | Ma | G09G 3/3233 |
| 2017/0270860 | A1 | 9/2017 | Wang et al. | |
| 2019/0096322 | A1 | 3/2019 | Gao | |
| 2019/0189054 | A1 | 6/2019 | Yang et al. | |
| 2020/0388214 | A1 | 12/2020 | Yang | |
| 2021/0074213 | A1 | 3/2021 | Huang et al. | |

FOREIGN PATENT DOCUMENTS

| | | | |
|---|---|---|---|
| CN | 104217674 | A | 12/2014 |
| CN | 105185305 | A | 12/2015 |
| CN | 105185306 | A | 12/2015 |
| CN | 105206221 | A | 12/2015 |
| CN | 106486054 | A | 3/2017 |
| CN | 107452331 | A | 12/2017 |
| CN | 107767819 | A | 3/2018 |
| CN | 107863069 | A | 3/2018 |
| CN | 207082320 | U | 3/2018 |
| CN | 207217082 | U | 4/2018 |
| CN | 207852284 | U | 9/2018 |
| CN | 109256094 | A | 1/2019 |
| CN | 109584795 | A | 4/2019 |
| CN | 109785799 | A | 5/2019 |
| KR | 20120061146 | A | 6/2012 |
| KR | 20120070773 | A | 7/2012 |

OTHER PUBLICATIONS

First Office Action (with English translation) issued in corresponding CN application No. 201910085298.3 dated Apr. 25, 2021 (18 pages).

* cited by examiner

PIXEL DRIVING CIRCUIT, PIXEL DRIVING METHOD AND DISPLAY DEVICE

CROSS-REFERENCE TO RELATED APPLICATIONS

The present application is the U.S. national phase of PCT Application No. PCT/CN2019/126182 filed on Dec. 18, 2019, which claims a priority of the Chinese patent application No. 201910085298.3 filed on Jan. 29, 2019, which are incorporated herein by reference in their entirety.

TECHNICAL FIELD

The present disclosure relates to the field of display technology, in particular to a pixel driving circuit, a pixel driving method and a display device.

BACKGROUND

Due to a hysteresis effect of a driving transistor, an afterimage occurs for a conventional Organic Light-Emitting Diode (OLED) display product when a black-and-white image is displayed for a certain time period and then switched into a gray image, and this afterimage disappears after a certain time period, i.e., it is called as a short-term afterimage. The hysteresis effect is related to a drift of a threshold voltage of the driving transistor.

SUMMARY

In one aspect, the present disclosure provides in some embodiments a pixel driving circuit, including a driving circuit, an initialization circuit and a compensation control circuit. A first end of the driving circuit is connected to a first voltage line. The initialization circuit is configured to write an initial voltage into a second end of the driving circuit under the control of an initialization control line. The compensation control circuit is configured to control a control end of the driving circuit to be electrically connected to the second end of the driving circuit under the control of a compensation control line, so as to write the initial voltage into the control end of the driving circuit.

In a possible embodiment of the present disclosure, the second end of the driving circuit is connected to a first electrode of a light-emitting element, and the initialization circuit is further configured to write the initial voltage into the first electrode of the light-emitting electrode under the control of the initialization control line, so as to enable the light-emitting element not to emit light.

In a possible embodiment of the present disclosure, the pixel driving circuit further includes a light-emission control circuit, the second end of the driving circuit is connected to the first electrode of the light-emitting element through the light-emission control circuit, and the light-emission control circuit is configured to control the second end of the driving circuit to be electrically connected to the first electrode of the light-emitting element under the control of a light-emission control line.

In a possible embodiment of the present disclosure, the pixel driving circuit further includes an energy storage circuit and a data write-in circuit. A first end of the energy storage circuit is connected to the control end of the driving circuit, the energy storage circuit is configured to control a potential at the control end of the driving circuit, the compensation control circuit is further connected to a reference voltage line and a second end of the energy storage circuit and configured to write a reference voltage across the reference voltage line into the second end of the energy storage circuit under the control of the compensation control line, and the data write-in circuit is configured to write a data voltage into the second end of the energy storage circuit under the control of a write-in control line.

In a possible embodiment of the present disclosure, the initialization circuit includes an initialization transistor, a control electrode of which is connected to the initialization control line, a first electrode of which is connected to the first electrode of the light-emitting element, and a second electrode of which is connected to an initial voltage line for applying the initial voltage.

In a possible embodiment of the present disclosure, the light-emission control circuit includes a light-emission control transistor, a control electrode of which is connected to the light-emission control line, a first electrode of which is connected to the second end of the driving circuit, and a second electrode of which is connected to the first electrode of the light-emitting element.

In a possible embodiment of the present disclosure, the compensation control circuit includes a first compensation control transistor, a control electrode of which is connected to the compensation control line, a first electrode of which is connected to the control end of the driving circuit, and a second electrode of which is connected to the second end of the driving circuit.

In a possible embodiment of the present disclosure, the pixel driving circuit further includes an energy storage circuit, and the compensation control circuit further includes a second compensation control transistor, a control electrode of which is connected to the compensation control line, a first electrode of which is connected to the reference voltage line, and a second electrode of which is connected to a second end of the energy storage circuit.

In a possible embodiment of the present disclosure, the energy storage circuit includes a storage capacitor, a first end of which is a first end of the energy storage circuit, and a second end of which is the second end of the energy storage circuit.

In a possible embodiment of the present disclosure, the driving circuit includes a driving transistor, a control electrode of which is the control end of the driving circuit, a first electrode of which is the first end of the driving circuit, and a second electrode of which is the second end of the driving circuit.

In a possible embodiment of the present disclosure, the data write-in circuit includes a data write-in transistor, a control electrode of which is connected to the write-in control line, a first electrode of which is connected to a data line for applying a data voltage, and a second electrode of which is connected to the second end of the storage capacitor.

In another aspect, the present disclosure provides in some embodiments a pixel circuit, including a light-emitting element, a storage capacitor, a driving transistor, an initialization transistor, a light-emission control transistor, a first compensation control transistor, a second compensation control transistor, and a data write-in transistor. A control electrode of the initialization transistor is connected to an initialization control line, a first electrode of the initialization transistor is connected to a first electrode of the light-emitting element, and a second electrode of the initialization transistor is connected to an initial voltage line for applying an initial voltage. A control electrode of the light-emission control transistor is connected to a light-emission control line, a first electrode of the light-emission control transistor is connected to a second electrode of the driving transistor, a second electrode of the light-emission control transistor is connected to the first electrode of the light-emitting element, and a second electrode of the light-emitting element is connected to a second voltage line. A control electrode of the first compensation control transistor is connected to a compensation control line, a first electrode of the first compensation control transistor is connected to a control electrode of the driving transistor, a second electrode of the first compensation control transistor is connected to the second electrode of the driving transistor, and a first electrode of the driving transistor is connected to a first voltage line. A control electrode of the second compensation control transistor is connected to the compensation control line, a first electrode of the second compensation control transistor is connected to a reference voltage line, a second electrode of the second compensation control transistor is connected to a second end of the storage capacitor, and a first end of the storage capacitor is connected to a control electrode of the driving transistor. A control electrode of the data write-in transistor is connected to a write-in control line, a first electrode of the data write-in transistor is connected to a data line for applying a data voltage, and a second electrode of the data write-in transistor is connected to the second end of the storage capacitor.

In yet another aspect, the present disclosure provides in some embodiments a pixel driving method for the above-mentioned pixel driving circuit or pixel circuit, including, at an initialization stage, writing, by an initialization circuit, an initial voltage into a second end of a driving circuit under the control of an initialization control line, and controlling, by a compensation control circuit, a control end of the driving circuit to be electrically connected to the second end of the driving circuit under the control of a compensation control line so as to write the initial voltage into the control end of the driving circuit.

In a possible embodiment of the present disclosure, the pixel driving circuit further includes a light-emission control circuit, and the second end of the driving circuit is connected to a first electrode of a light-emitting element through the light-emission control circuit. The pixel driving method further includes, at the initialization stage, controlling, by the light-emission control circuit, the second end of the driving circuit to be electrically connected to the first electrode of the light-emitting element under the control of a light-emission control line.

In a possible embodiment of the present disclosure, a compensation stage and a light emission stage are provided after the initialization stage. The pixel driving circuit further includes an energy storage circuit and a data write-in circuit, and the compensation control circuit is further connected to a reference voltage line and a second end of the energy storage circuit. The driving circuit includes a driving transistor, a control electrode of which is the control end of the driving circuit, a first electrode of which is a first end of the driving circuit, and a second electrode of which is the second end of the driving circuit. The pixel driving method further includes: at the compensation stage, writing, by the data write-in circuit, a data voltage into a second end of the energy storage circuit under the control of the light-emission control line, controlling, by the compensation control circuit, the control electrode of the driving transistor to be electrically connected to the second electrode of the driving transistor under the control of the compensation control line, controlling, by the driving transistor, the first electrode of the driving transistor to be electrically connected to the second electrode of the driving transistor under the control of the control electrode of the driving transistor, so as to charge the energy storage circuit through a first voltage V1 applied by a first voltage line, controlling, by the driving transistor, the first electrode of the driving transistor to be electrically disconnected from the second electrode of the driving transistor when a potential at the control electrode of the driving transistor is V1+Vth, and controlling, by the light-emission control circuit, the second electrode of the driving transistor to be electrically disconnected from the first electrode of the light-emitting element under the control of the light-emission control line, where Vth represents a threshold voltage of the driving transistor; and at the light emission stage, writing, by the compensation control circuit, a reference voltage into the second end of the energy storage circuit under the control of the compensation control line, controlling, by the light-emission control circuit, the second electrode of the driving transistor to be electrically connected to the first electrode of the light-emitting element under the control of the light-emission control line, and driving, by the driving transistor, the light-emitting element to emit light.

In a possible embodiment of the present disclosure, the pixel driving method further includes: at the compensation stage, writing, by the initialization circuit, the initial voltage into the first electrode of the light-emitting element under the control of the initialization control line so as to enable the light-emitting element not to emit light; and at the light emission stage, stopping, by the initialization circuit, the writing of the initial voltage into the first electrode of the light-emitting element under the control of the initialization control line.

In still yet another aspect, the present disclosure provides in some embodiments a display device including the above-mentioned pixel driving circuit or pixel circuit.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be triodes, thin film transistors (TFTs), field effect transistors (FETs) or any other elements having an identical characteristic. In order to differentiate two electrodes other than a control electrode from each other, one of the two electrodes is called as first electrode and the other is called as second electrode.

In actual use, when the transistor is a triode, the control electrode may be a base, the first electrode may be a collector and the second electrode may be an emitter, or the control electrode may be a base, the first electrode may be an emitter and the second electrode may be a collector.

In actual use, when the transistor is a TFT or FET, the control electrode may be a gate electrode, the first electrode may be a drain electrode and the second electrode may be a source electrode, or the control electrode may be a gate electrode, the first electrode may be a source electrode and the second electrode may be a drain electrode.

In some embodiment of the present disclosure, in order to prevent the occurrence of a short-term afterimage due to a hysteresis effect, a driving transistor is charged and discharged many times at an initialization stage. In addition, a light-emitting control transistor is not turned on during the charging and discharging, and light is emitted by the light-emitting control transistor when the driving transistor is in a stable state. However, in the above scheme, a large quantity of transistors is adopted, and an operational process is complex.

Figure 1A:
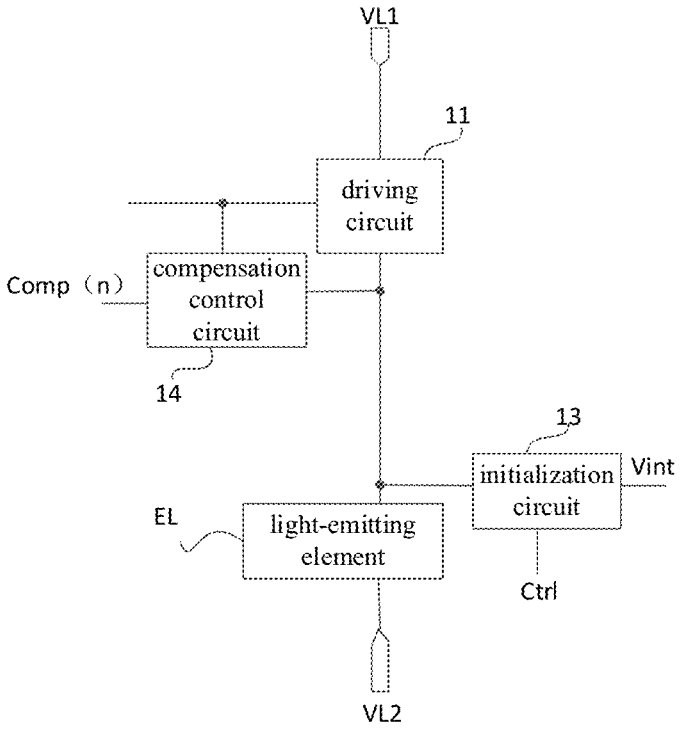
FIG. 1A is a schematic view showing a pixel driving circuit according to one embodiment of the present disclosure.

As shown in FIG. 1A, the present disclosure provides in some embodiments a pixel driving circuit for driving a light-emitting element EL. The pixel driving circuit includes a driving circuit 11, an initialization circuit 13 and a compensation control circuit 14. A first end of the driving circuit 11 is connected to a first voltage line VL1, a second end of the driving circuit 11 is connected to a first electrode of the light-emitting element EL, and a second end of the light-emitting element EL is connected to a second voltage line VL2. The initialization circuit 13 is configured to write an initial voltage Vint into the first electrode of the light-emitting element EL under the control of an initialization control line Ctrl so as to enable the light-emitting element EL not to emit light. The initialization circuit 13 is further configured to write the initial voltage Vint into the second end of the driving circuit 11 under the control of the initialization control line Ctrl. The compensation control circuit 14 is configured to control a control end of the driving circuit 11 to be electrically connected to the second end of the driving circuit 11 under the control of a compensation control line Comp(n), so as to write the initial voltage Vint into the control end of the driving circuit 11, thereby to enable the driving circuit 11 to control the first end of the driving circuit 11 to be electrically connected to the second end of the driving circuit 11 under the control of the control end of the driving circuit 11.

During the implementation, the initialization control line Ctrl may be, but not limited to, the compensation control line Comp(n).

According to the embodiments of the present disclosure, the pixel driving circuit includes the initialization circuit 13 and the compensation control circuit 14, so as to apply the initial voltage Vint to the control end of the driving circuit 11 at an initialization stage, thereby to enable a driving transistor of the driving circuit 11 to be in an on-bias state. Hence, no matter whether a data voltage for displaying a previous image corresponds to a black image or a white image, data write-in and threshold compensation may be performed on the driving transistor of the driving circuit 11 in the on-bias state, so it is able to prevent the occurrence of the short-term afterimage due to a hysteresis effect. In addition, the initialization circuit 13 may control a potential at the first electrode of the light-emitting element EL to be the initial voltage Vint under the control of the initialization control line Ctrl, so as to initialize the potential at the first electrode of the light-emitting element EL and enable the light-emitting element not to emit light at the initialization stage, thereby to prevent a luminous brightness value from being adversely affected by residual charges on the first electrode of the light-emitting element EL. During the implementation, the second voltage line VL2 may be, but not limited to, a low voltage line or a ground line.

During the implementation, the light-emitting element EL may be an OLED, the first electrode of the light-emitting element EL may be, but not limited to, an anode of the OLED, and the second electrode of the light-emitting element EL may be, but not limited to, a cathode of the OLED.

During the operation of the pixel driving circuit in FIG. 1A, at the initialization stage, the initialization circuit 13 may write the initial voltage Vint into the first electrode of the light-emitting element EL under the control of the initialization control line Ctrl, so as to enable the light-emitting element EL not to emit light. The initialization circuit 13 may write the initial voltage Vint into the second end of the driving circuit 11 under the control of the initialization control line Ctrl. The compensation control circuit 14 may control the control end of the driving circuit 11 to be electrically connected to the second end of the driving circuit 11 under the control of the compensation control line Comp(n), so as to write the initial voltage Vint into the control end of the driving circuit 11. The driving circuit 11 may control the first end of the driving circuit 11 to be electrically connected to the second end of the driving circuit 11 under the control of its control end.

During the implementation, the pixel driving circuit may further include a light-emission control circuit, the second end of the driving circuit may be connected to the first electrode of the light-emitting element through the light-emission control circuit, and the light-emission control circuit is configured to control the second end of the driving circuit to be electrically connected to the first electrode of the light-emitting element under the control of a light-emission control line.

In some embodiments of the present disclosure, the pixel driving circuit may further include the light-emission control circuit so as to control the second end of the driving circuit to be electrically connected to, or electrically disconnected from, the first electrode of the light-emitting element under the control of the light-emission control line.

Figure 1B:
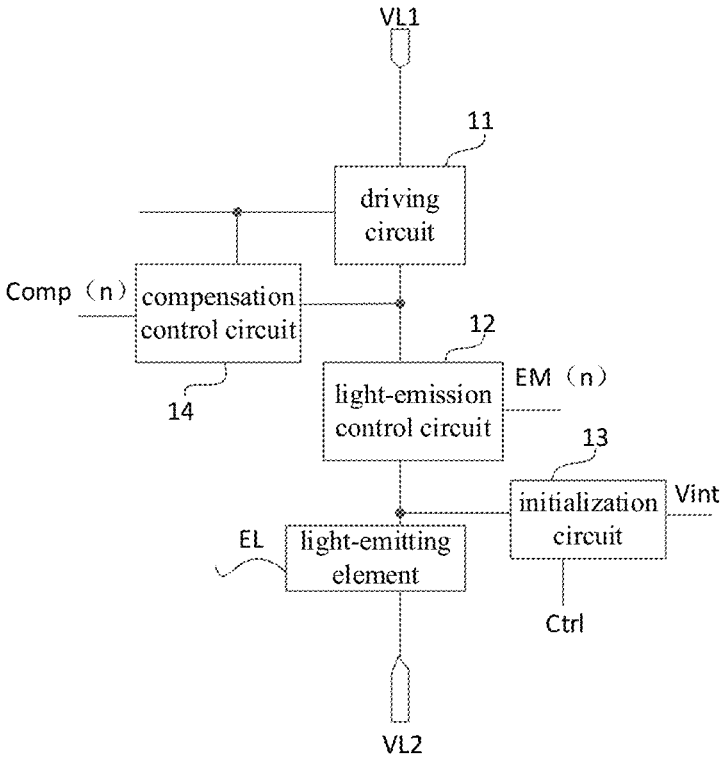
FIG. 1B is another schematic view showing the pixel driving circuit according to one embodiment of the present disclosure.

As shown in FIG. 1B, on the basis of the pixel driving circuit in FIG. 1A, the pixel driving circuit may further include a light-emission control circuit 12 through which the second end of the driving circuit 11 is connected to the first electrode of the light-emitting element EL. The light-emission control circuit 12 is configured to control the second end of the driving circuit 11 to be electrically connected to the first electrode of the light-emitting element EL under the control of the light-emission control line EM(n).

During the operation of the pixel driving circuit in FIG. 1B, at the initialization stage, the light-emission control circuit 12 may control the second end of the driving circuit 11 to be electrically connected to the first electrode of the light-emitting element EL under the control of the light-emission control line EM(n).

During the implementation, the pixel driving circuit may further include an energy storage circuit and a data write-in circuit. A first end of the energy storage circuit may be connected to the control end of the driving circuit, and the energy storage circuit is configured to control a potential at the control end of the driving circuit. The compensation control circuit may be further connected to a reference voltage line and a second end of the energy storage circuit, and configured to write a reference voltage of the reference voltage line into the second end of the energy storage circuit under the control of the compensation control line. The data write-in circuit is configured to write a data voltage into the second end of the energy storage circuit under the control of a write-in control line.

In some embodiments of the present disclosure, the pixel driving circuit may further include the energy storage circuit and the data write-in circuit, and the compensation control circuit may be further connected to the reference voltage line and the second end of the energy storage circuit, so as to achieve a data write-in function and a threshold compensation function.

Figure 2:
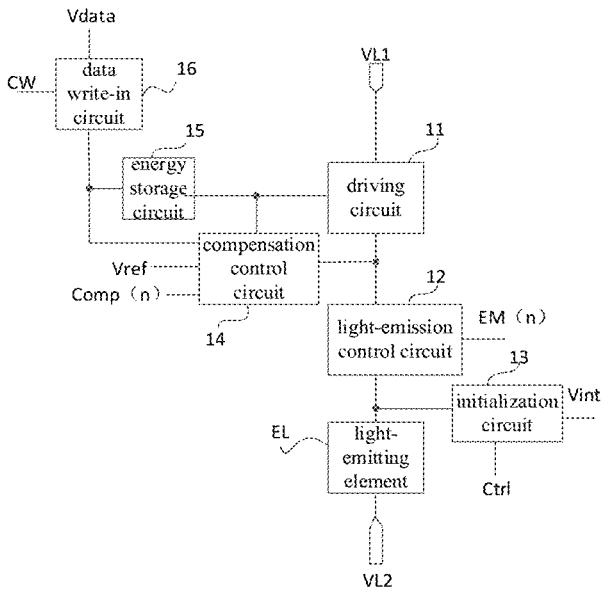
FIG. 2 is yet another schematic view showing the pixel driving circuit according to one embodiment of the present disclosure.

As shown in FIG. 2, on the basis of the pixel driving circuit in FIG. 1B, the pixel driving circuit may further include an energy storage circuit 15 and a data write-in circuit 16. A first end of the energy storage circuit 15 may be connected to the control end of the driving circuit 11, and the energy storage circuit is configured to control the potential at the control end of the driving circuit 11. The compensation control circuit 14 may be further connected to a reference voltage line and a second end of the energy storage circuit 15, and configured to write a reference voltage Vref of the reference voltage line into the second end of the energy storage circuit 15 under the control of the compensation control line Comp(n). The data write-in circuit 16 is configured to write a data voltage Vdata into the second end of the energy storage circuit 15 under the control of a write-in control line CW.

During the implementation, the write-in control line CW may be, but not limited to, the compensation control line Comp(n).

During the operation of the pixel driving circuit in FIG. 2, a compensation stage and a light emission stage may be provided after the initialization stage. The driving circuit 11 may include a driving transistor, a control electrode of which is the control end of the driving circuit, a first electrode of which is the first end of the driving circuit and a second electrode of which is the second end of the driving circuit.

At the compensation stage, the data write-in circuit 16 may write the data voltage Vdata into the second end of the energy storage circuit 15 under the control of the write-in control line CW. The compensation control circuit 14 may control the control electrode of the driving transistor to be electrically connected to the second electrode of the driving transistor under the compensation control line Comp(n). The driving transistor may control the first electrode of the driving transistor to be electrically connected to the second electrode of the driving transistor under the control of its control electrode, so as to charge the energy storage circuit 15 through the first voltage V1 applied by the first voltage line VL1 until the potential at the control electrode of the driving transistor is V1+Vth. The driving transistor may control the first electrode thereof to be electrically disconnected from the second electrode. The light-emission control circuit 12 may control the second electrode of the driving transistor to be electrically disconnected from the first electrode of the light-emitting element EL under the control of the light-emission control line EM(n). The initialization circuit 13 may write the initial voltage Vint into the first electrode of the light-emitting element EL under the control of the initialization control line Ctrl, so as to enable the light-emitting element EL not to emit light. Vth represents a threshold voltage of the driving transistor.

At the light emission stage, the initialization circuit 13 may stop the writing of the initial voltage Vint into the first electrode of the light-emitting element EL under the control of the initialization control line Ctrl. The compensation control circuit 14 may write the reference voltage Vref into the second end of the energy storage circuit 15 under the control of the compensation control line Comp(n). The light-emission control circuit 12 may control the second electrode of the driving transistor to be electrically connected to the first electrode of the light-emitting element EL under the control of the light-emission control line EM(n). The driving transistor may drive the light-emitting element EL to emit light.

To be specific, the initialization circuit may include an initialization transistor, a control electrode of which is connected to the initialization control line, a first electrode of which is connected to the first electrode of the light-emitting element, and a second electrode of which is connected to an initial voltage line for applying the initial voltage.

To be specific, the light-emission control circuit may include a light-emission control transistor, a control electrode of which is connected to the light-emission control line, a first electrode of which is connected to the second end of the driving circuit, and a second electrode of which is connected to the first electrode of the light-emitting element.

To be specific, the compensation control circuit may include a first compensation control transistor, a control electrode of which is connected to the compensation control line, a first electrode of which is connected to the control end of the driving circuit, and a second electrode of which is connected to the second end of the driving circuit.

During the implementation, the compensation control circuit may further include a second compensation control transistor, a control electrode of which is connected to the compensation control line, a first electrode of which is connected to the reference voltage line, and a second electrode of which is connected to the second end of the energy storage circuit.

In actual use, the energy storage circuit may include a storage capacitor, the driving circuit may include a driving transistor, and the data write-in circuit may include a data write-in transistor. A first end of the storage capacitor may be the first end of the energy storage circuit, and a second end of the storage capacitor may be the second end of the energy storage circuit. A control electrode of the driving transistor may be the control end of the driving circuit, a first electrode of the driving transistor may be the first end of the driving circuit, and a second electrode of the driving transistor may be the second end of the driving circuit. A control electrode of the data write-in transistor may be connected to the write-in control line, a first electrode of the data write-in transistor may be connected to a data line for applying the data voltage, and a second electrode of the data write-in transistor may be connected to the second end of the storage capacitor.

During the implementation, the light-emitting element may be an OLED, the first electrode of the light-emitting element may be an anode of the OLED, and the second electrode of the light-emitting element may be a cathode of the OLED.

The pixel driving circuit will be described hereinafter in conjunction with a specific embodiment.

Figure 3:
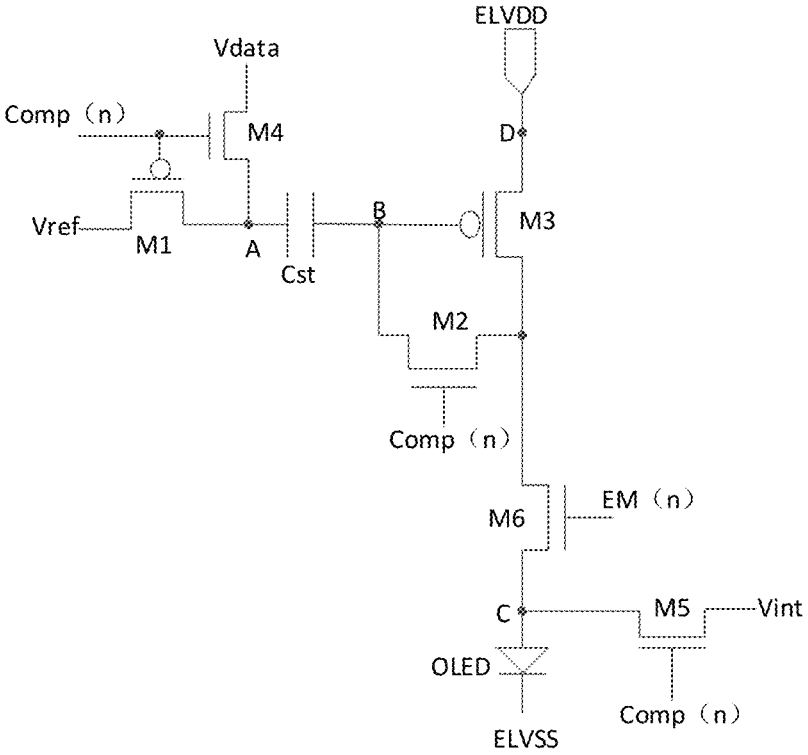
FIG. 3 is a circuit diagram of the pixel driving circuit according to one embodiment of the present disclosure.

As shown in FIG. 3, the pixel driving circuit for driving an OLED may include a driving circuit, a light-emission control circuit, an initialization circuit, a compensation control circuit, an energy storage circuit and a data write-in circuit.

The initialization circuit may include an initialization transistor M5, the light-emission control circuit may include a light-emission control transistor M6, the compensation control circuit may include a first compensation control transistor M2 and a second compensation control transistor M1, the energy storage circuit may include a storage capacitor Cst, the driving circuit may include a driving transistor M3, and the data write-in circuit may include a data write-in transistor M4.

A cathode of the OLED is configured to receive a low voltage ELVSS. A gate electrode of the initialization transistor M5 may be connected to the compensation control line Comp(n), a source electrode thereof may be connected to an anode of the OELD, and a drain electrode thereof may be connected to the initial voltage line for applying the initial voltage Vint.

A gate electrode of the light-emission control transistor M6 may be connected to the light-emission control line EM(n), a drain electrode thereof may be connected to a drain electrode of the driving transistor M3, and source electrode thereof may be connected to the anode of the OLED.

A gate electrode of the driving transistor M3 may be connected to a first end of the storage capacitor Cst, and a source electrode thereof may receive a power source voltage ELVDD.

A gate electrode of the first compensation control transistor M2 may be connected to the compensation control line Comp(n), a source electrode thereof may be connected to the gate electrode of the driving transistor M3, and a drain electrode thereof may be connected to the drain electrode of the driving transistor M3.

A gate electrode of the second compensation control transistor M1 may be connected to the compensation control line Comp(n), a source electrode thereof may be connected to the reference voltage line for applying the reference voltage Vref, and a drain electrode thereof may be connected to a second end of the storage capacitor Cst.

A gate electrode of the data write-in transistor M4 may be connected to the compensation control line Comp(n), a drain electrode thereof may receive the data voltage Vdata, and a source electrode thereof may be connected to the second end A of the storage capacitor Cst.

In FIG. 3, the first voltage line may be, but not limited to, a power source voltage line for applying EVLDD, and the second voltage line may be, but not limited to, a low voltage line for applying ELVSS.

In FIG. 3, M1 and M3 may each be, but not limited to, a P-channel Metal Oxide Semiconductor (PMOS) FET, and M2, M4, M5 and M6 may each be, but not limited to, an N-channel Metal Oxide Semiconductor (NMOS) FET.

In FIG. 3, a node A may be a node connected to the second end of Cst, a node B may be a node connected to the first end of Cst, a node C may be a node connected to the anode of OLED, and a node D may be a node connected to the source electrode of M3.

In FIG. 3, the initialization control line and the write-in control line may each be, but not limited to, the compensation control line Comp(n).

Figure 4:
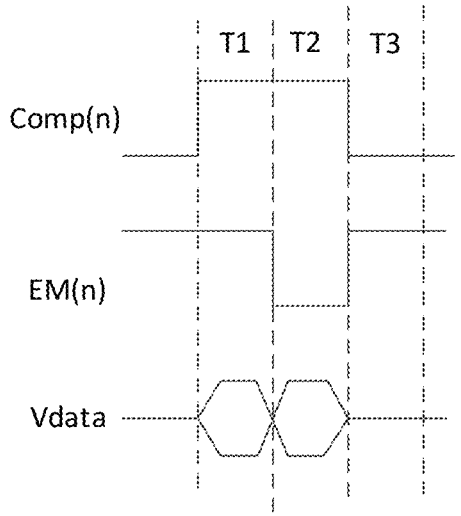
FIG. 4 is a time sequence diagram of the pixel driving circuit according to one embodiment of the present disclosure.
Figure 5:
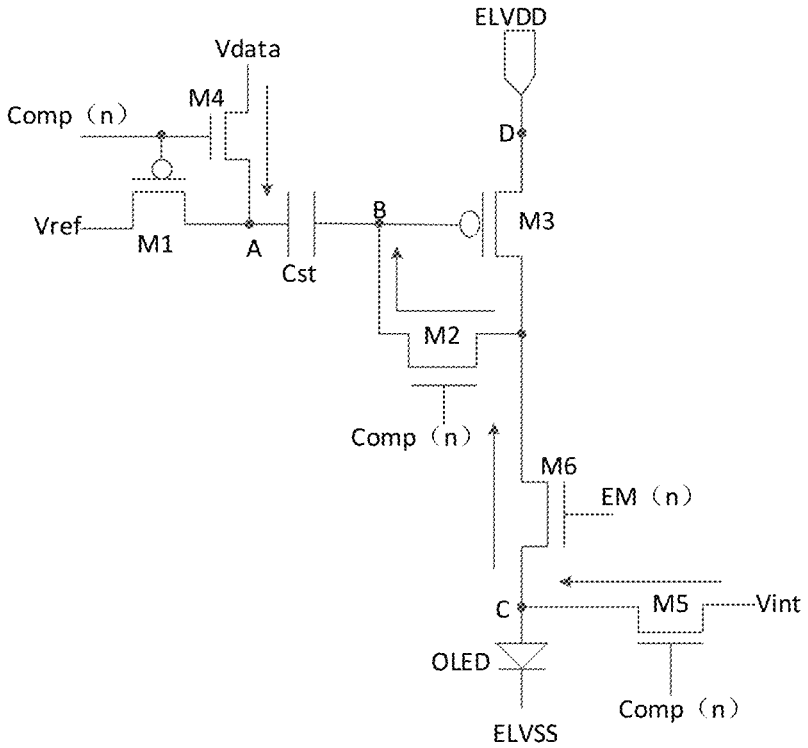
FIG. 5 is a schematic view showing an operating state of the pixel driving circuit at an initialization stage T1 according to one embodiment of the present disclosure.

As shown in FIG. 4, during the operation of the pixel driving circuit in FIG. 3, at the initialization stage T1, a high level may be inputted to Comp(n) and EM(n), so as to turn off M1, and turn on M2, M3, M4, M5 and M6, as shown in FIG. 5. Vdata may be applied to the node A via M4, Vint may be applied to the node B via M5, M6 and M2, and ELVDD may be applied to the node D. At this time, a voltage applied to the node A may be Vdata1 (i.e., a data voltage applied to a previous row of pixel units), a voltage applied to the node B may be Vint, a potential at the node C may be Vint, a potential at the node D may be ELVDD, and M3 may be in an on state. Hence, no matter whether a data voltage for displaying a previous image corresponds to a black image or a white image, a data write-in operation and a threshold compensation operation may be performed on M3 in the on state, so it is able to prevent the occurrence of the short-term image due to the hysteresis effect. In addition, Vint may be applied to the anode of the OLED, and at this time the OLED may not emit light, so it is able to prevent a luminous brightness value from being adversely affected by residual charges on the anode of the OLED.

Figure 6:
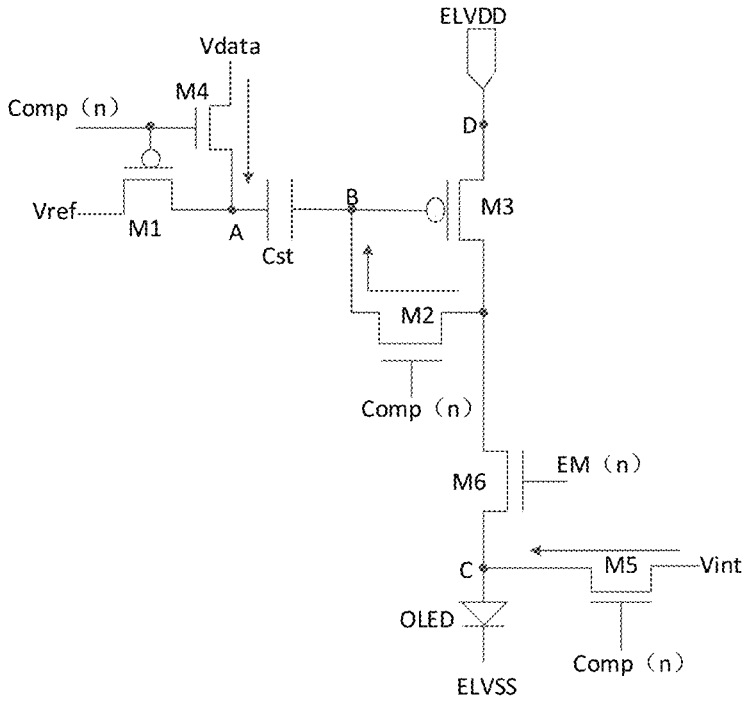
FIG. 6 is a schematic view showing an operating state of the pixel driving circuit at a compensation stage T2 according to one embodiment of the present disclosure.

At the compensation stage T2, a high level may be inputted to Comp(n), and a low level may be inputted to EM(n), so as to turn off M1 and M6, and turn on M2, M3, M4 and M5 as shown in FIG. 6. Vdata may be applied to the node A so as to write a data voltage desired for driving a current row of pixel units to emit light, Vint may be applied to the node C via M5, so as to enable the OLED not to emit light. ELVDD may be applied to the node B via M2 and M3, so as to charge Cst, thereby to pull up the potential at the node B until the potential at the node B is ELVDD+Vth, where Vth represents a threshold voltage of M3. At this time, the potential at the node D may be ELVDD.

Figure 7:
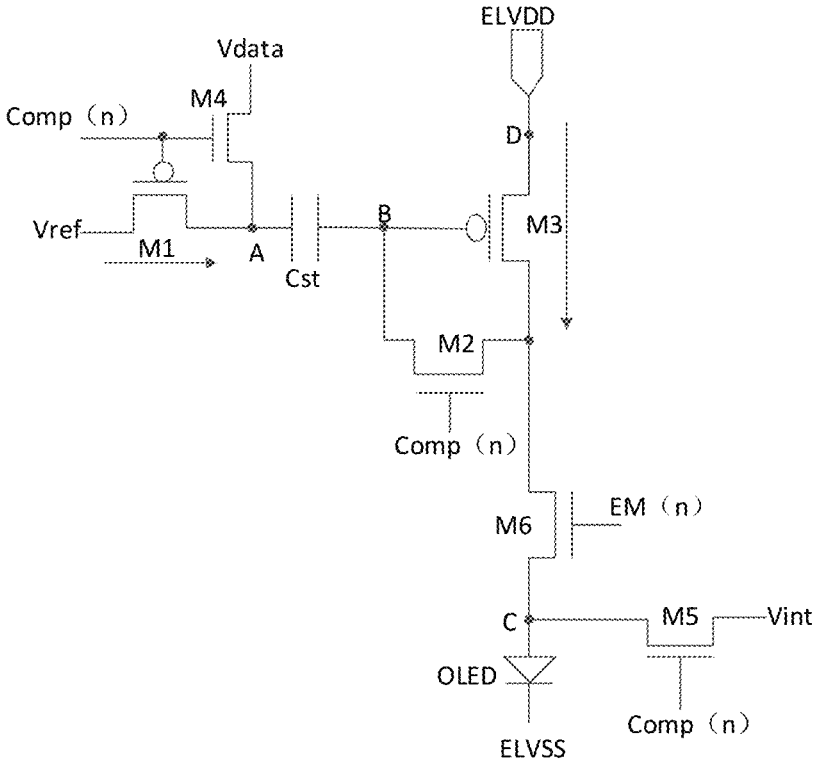
FIG. 7 is a schematic view showing an operating state of the pixel driving circuit at a light emission stage T3 according to one embodiment of the present disclosure.

At the light emission stage T3, a low level may be inputted to Comp(n), and a high level may be inputted to EM(n), so as to turn off M2, M4 and M5, and turn on M1, M3 and M6 as shown in FIG. 7. Vref may be applied to the node A via M1, i.e., the voltage applied to the node A may be changed from Vdata to Vref and a change of the voltage applied to the node A may be Vref-Vdata. Due to a coupling effect of Cst, the voltage applied to the node B may be changed from ELVDD+Vth to ELVDD+Vth+Vref-Vdata. At this time, the potential at the node D may be still ELVDD, and a driving current Ioled flowing through M3 to driving the OLED may be $Ioled=K*(Vgs-Vth)^2=K*(ELVDD+Vth+Vref-Vdata-ELVDD-Vth)^2=K*(Vdata-Vref)$, where Vgs represents a gate-to-source voltage applied to M3. Based on the above equation, Ioled may be irrelevant to ELVDD and Vth. In this regard, it is able to eliminate the short-term afterimage due to a drift of the threshold voltage of the driving transistor, thereby to improve a display effect.

The present disclosure further provides in some embodiments a pixel driving method for the above-mentioned pixel driving circuit. The pixel driving method includes, at an initialization stage, writing, by an initialization circuit, an initial voltage into a first electrode of a light-emitting element under the control of an initialization control line so as to enable the light-emitting element not to emit light, and controlling, by a compensation control circuit, a control end of the driving circuit to be electrically connected to a second end of the driving circuit under the control of a compensation control line so as to write the initial voltage into the control end of the driving circuit, thereby to enable the driving circuit to control a first end of the driving circuit to be electrically connected to the second end of the driving circuit under the control of the control end of the driving circuit.

During the implementation, the pixel driving circuit may further include a light-emission control circuit, and the second end of the driving circuit may be connected to the first electrode of to light-emitting element through the light-emission control circuit. The pixel driving method may further include, at the initialization stage, controlling, by the light-emission control circuit, the second end of the driving circuit to be electrically connected to the first electrode of the light-emitting element under the control of a light-emission control line.

To be specific, a compensation stage and a light emission stage may be provided after the initialization stage. The pixel driving circuit may further include an energy storage circuit and a data write-in circuit, and the compensation control circuit may be further connected to a reference voltage line and a second end of the energy storage circuit. The driving circuit may include a driving transistor, a control electrode of which is the control end of the driving circuit, a first electrode of which is a first end of the driving circuit, and a second electrode of which is the second end of the driving circuit. The pixel driving method may further include: at the compensation stage, writing, by the data write-in circuit, a data voltage into a second end of the energy storage circuit under the control of the light-emission control line, controlling, by the compensation control circuit, the control electrode of the driving transistor to be electrically connected to the second electrode of the driving transistor under the control of the compensation control line, controlling, by the driving transistor, the first electrode of the driving transistor to be electrically connected to the second electrode of the driving transistor under the control of the control electrode of the driving transistor, so as to charge the energy storage circuit through a first voltage V1 applied by a first voltage line, controlling, by the driving transistor, the first electrode of the driving transistor to be electrically disconnected from the second electrode of the driving transistor when a potential at the control electrode of the driving transistor is V1+Vth, and controlling, by the light-emission control circuit, the second electrode of the driving transistor to be electrically disconnected from the first electrode of the light-emitting element under the control of the light-emission control line, where Vth represents a threshold voltage of the driving transistor; and at the light emission stage, writing, by the compensation control circuit, a reference voltage into the second end of the energy storage circuit under the control of the compensation control line so as to enable a potential at the first end of the energy storage circuit to change correspondingly, controlling, by the light-emission control circuit, the second electrode of the driving transistor to be electrically connected to the first electrode of the light-emitting element under the control of the light-emission control line, and driving, by the driving transistor, the light-emitting element to emit light.

To be specific, in some embodiments of the present disclosure, the pixel driving method may further include: at the compensation stage, writing, by the initialization circuit, the initial voltage into the first electrode of the light-emitting element under the control of the initialization control line so as to enable the light-emitting element not to emit light; and at the light emission stage, stopping, by the initialization circuit, the writing of the initial voltage into the first electrode of the light-emitting element under the control of the initialization control line.

The present disclosure further provides in some embodiments a display device including the above-mentioned pixel driving circuit and a pixel circuit.

In the embodiments of the present disclosure, the display device may be any product or member having a display function, e.g., mobile phone, tablet personal computer, television, display, laptop computer, digital phot frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel driving circuit, comprising a driving circuit, an initialization circuit and a compensation control circuit, wherein a first end of the driving circuit is connected to a first voltage line, wherein the initialization circuit is configured to write an initial voltage into a second end of the driving circuit under the control of an initialization control line, wherein the compensation control circuit is configured to control a control end of the driving circuit to be electrically connected to the second end of the driving circuit under the control of a compensation control line, so as to write the initial voltage into the control end of the driving circuit, wherein the compensation control circuit comprises a first compensation control transistor and a second compensation control transistor, wherein a control electrode of the first compensation control transistor is connected to the compensation control line, a first electrode of the first compensation control transistor is connected to the control end of the driving circuit, and a second electrode of the first compensation control transistor is connected to the second end of the driving circuit, wherein a control electrode of the second compensation control transistor is directly connected to the compensation control line, a first electrode of the second compensation control transistor is connected to the reference voltage line, and a second electrode of the second compensation control transistor is connected to a second end of the energy storage circuit, wherein the data write-in circuit comprises a data write-in transistor, a control electrode of which is directly connected to the compensation control line, a first electrode of which is directly connected to a data line for inputting a data voltage, and a second electrode of which is connected to the second end of the storage capacitor, and wherein the driving circuit comprises a driving transistor, a control electrode of which is connected to the first electrode of the first compensation control transistor, a second electrode of which is connected to the second electrode of the first compensation control transistor, and a first electrode of which is directly connected to the first voltage line.

2. The pixel driving circuit according to claim 1, wherein the second end of the driving circuit is connected to a first electrode of a light-emitting element, and the initialization circuit is further configured to write the initial voltage into the first electrode of the light-emitting electrode under the control of the initialization control line, so as to enable the light-emitting element not to emit light.

3. The pixel driving circuit according to claim 2, further comprising a light-emission control circuit, wherein the second end of the driving circuit is connected to the first electrode of the light-emitting element through the light-emission control circuit, and the light-emission control circuit is configured to control the second end of the driving circuit to be electrically connected to the first electrode of the light-emitting element under the control of a light-emission control line.

4. The pixel driving circuit according to claim 3, wherein the light-emission control circuit comprises a light-emission control transistor, a control electrode of which is connected to the light-emission control line, a first electrode of which is connected to the second end of the driving circuit, and a second electrode of which is connected to the first electrode of the light-emitting element.

5. The pixel driving circuit according to claim 2, wherein the initialization circuit comprises an initialization transistor, a control electrode of which is connected to the initialization control line, a first electrode of which is connected to the first electrode of the light-emitting element, and a second electrode of which is connected to an initial voltage line for inputting the initial voltage.

6. The pixel driving circuit according to claim 1, further comprising an energy storage circuit and a data write-in circuit, wherein a first end of the energy storage circuit is connected to the control end of the driving circuit, the energy storage circuit is configured to control a potential at the control end of the driving circuit, the compensation control circuit is further connected to a reference voltage line and a second end of the energy storage circuit and configured to write a reference voltage of the reference voltage line into the second end of the energy storage circuit under the control of the compensation control line, and the data write-in circuit is configured to write a data voltage into the second end of the energy storage circuit under the control of a write-in control line.

7. The pixel driving circuit according to claim 6, wherein the energy storage circuit comprises a storage capacitor, a first end of which is a first end of the energy storage circuit, and a second end of which is the second end of the energy storage circuit.

8. A display device, comprising the pixel driving circuit according to claim 1.

9. A pixel circuit, comprising a light-emitting element, a storage capacitor, a driving transistor, an initialization transistor, a light-emission control transistor, a first compensation control transistor, a second compensation control transistor, and a data write-in transistor, wherein a control electrode of the initialization transistor is connected to an initialization control line, a first electrode of the initialization transistor is connected to a first electrode of the light-emitting element, and a second electrode of the initialization transistor is connected to an initial voltage line for inputting an initial voltage, wherein a control electrode of the light-emission control transistor is connected to a light-emission control line, a first electrode of the light-emission control transistor is connected to a second electrode of the driving transistor, a second electrode of the light-emission control transistor is connected to the first electrode of the light-emitting element, and a second electrode of the light-emitting element is connected to a second voltage line, wherein a control electrode of the first compensation control transistor is connected to a compensation control line, a first electrode of the first compensation control transistor is connected to a control electrode of the driving transistor, a second electrode of the first compensation control transistor is connected to the second electrode of the driving transistor, and a first electrode of the driving transistor is directly connected to a first voltage line, wherein a control electrode of the second compensation control transistor is directly connected to the compensation control line, a first electrode of the second compensation control transistor is connected to a reference voltage line, a second electrode of the second compensation control transistor is connected to a second end of the storage capacitor, and a first end of the storage capacitor is connected to a control electrode of the driving transistor, and wherein a control electrode of the data write-in transistor is directly connected to the compensation control line, a first electrode of the data write-in transistor is connected to a data line for inputting a data voltage, and a second electrode of the data write-in transistor is connected to the second end of the storage capacitor.

10. A pixel driving method for the pixel circuit according to claim 9, comprising:

at an initialization stage, writing, by an initialization circuit, an initial voltage into a second end of a driving circuit under the control of an initialization control line, and controlling, by a compensation control circuit, a control end of the driving circuit to be electrically connected to the second end of the driving circuit under the control of a compensation control line so as to write the initial voltage into the control end of the driving circuit.

11. A display device, comprising the pixel circuit according to claim 9.

12. A pixel driving method for a pixel driving circuit, wherein the pixel driving circuit includes a driving circuit, an initialization circuit and a compensation control circuit, wherein a first end of the driving circuit is connected to a first voltage, wherein the initialization circuit is configured to write an initial voltage into a second end of the driving circuit under the control of an initialization control line, wherein the compensation control circuit is configured to control a control end of the driving circuit to be electrically connected to the second end of the driving circuit under the control of a compensation control line, so as to write the initial voltage into the control end of the driving circuit, wherein the method comprises:

at an initialization stage, writing, by an initialization circuit, an initial voltage into a second end of a driving circuit under the control of an initialization control line; and controlling, by a compensation control circuit, a control end of the driving circuit to be electrically connected to the second end of the driving circuit under the control of a compensation control line so as to write the initial voltage into the control end of the driving circuit, wherein the pixel driving circuit further comprises a light-emission control circuit, and the second end of the driving circuit is connected to a first electrode of a light-emitting element through the light-emission control circuit, wherein the pixel driving method further comprises: at the initialization stage, controlling, by the light-emission control circuit, the second end of the driving circuit to be electrically connected to the first electrode of the light-emitting element under the control of a light-emission control line, wherein a compensation stage and a light emission stage are provided after the initialization stage, the pixel driving circuit further comprises an energy storage circuit and a data write-in circuit, and the compensation control circuit is further connected to a reference voltage line and a second end of the energy storage circuit, wherein the driving circuit comprises a driving transistor, a control electrode of which is the control end of the driving circuit, a first electrode of which is a first end of the driving circuit, and a second electrode of which is the second end of the driving circuit, and wherein the pixel driving method further comprises:

at the compensation stage, writing, by the data write-in circuit, a data voltage into a second end of the energy storage circuit under the control of the light-emission control line, controlling, by the compensation control circuit, the control electrode of the driving transistor to be electrically connected to the second electrode of the driving transistor under the control of the compensation control line, controlling, by the driving transistor, the first electrode of the driving transistor to be electrically connected to the second electrode of the driving transistor under the control of the control electrode of the driving transistor, so as to charge the energy storage circuit through a first voltage V1 inputted by a first voltage line, controlling, by the driving transistor, the first electrode of the driving transistor to be electrically disconnected from the second electrode of the driving transistor when a potential at the control electrode of the driving transistor is V1+Vth, and controlling, by the light-emission control circuit, the second electrode of the driving transistor to be electrically disconnected from the first electrode of the light-emitting element under the control of the light-emission control line, wherein Vth represents a threshold voltage of the driving transistor, and at the light emission stage, writing, by the compensation control circuit, a reference voltage into the second end of the energy storage circuit under the control of the compensation control line, controlling, by the light-emission control circuit, the second electrode of the driving transistor to be electrically connected to the first electrode of the light-emitting element under the control of the light-emission control line, and driving, by the driving transistor, the light-emitting element to emit light.

13. The pixel driving method according to claim 12, further comprising:

at the compensation stage, writing, by the initialization circuit, the initial voltage into the first electrode of the light-emitting element under the control of the initialization control line so as to enable the light-emitting element not to emit light; and at the light emission stage, stopping, by the initialization circuit, the writing of the initial voltage into the first electrode of the light-emitting element under the control of the initialization control line.

* * * * *